United States Patent [19]

Inaba

[11] Patent Number: 4,736,887

[45] Date of Patent: Apr. 12, 1988

[54] EXTENSIBLE STRAW ASSEMBLY FOR BEVERAGES

[76] Inventor: Koichi Inaba, 1994 Denpo Takishita, Fuji-Shi, Shizuoka-Ken, Japan

[21] Appl. No.: 37,793

[22] Filed: Apr. 13, 1987

Related U.S. Application Data

[63] Continuation-in-part of Ser. No. 833,069, Feb. 26, 1986, Pat. No. 4,688,721.

[30] Foreign Application Priority Data

Mar. 8, 1985 [JP] Japan ..... 60-32897
Apr. 22, 1986 [JP] Japan ..... 61-91377

[51] Int. Cl.[4] ..... A47G 21/18; F16L 15/02
[52] U.S. Cl. ..... 239/33; 285/165
[58] Field of Search ..... 239/33; 285/165, 302, 285/DIG. 22; 138/120

[56] References Cited

U.S. PATENT DOCUMENTS 2,248,231 7/1941 Hamilton ..... 239/33
2,815,981 12/1957 Nonnamaker et al. ..... 239/33
4,657,182 4/1987 Hoshi ..... 239/33

FOREIGN PATENT DOCUMENTS 286114 12/1986 Japan ..... 239/33
86/07529 12/1986 PCT Int'l Appl. ..... 239/33

*Primary Examiner*—Andres Kashnikow
*Assistant Examiner*—Patrick N. Burkhart
*Attorney, Agent, or Firm*—Price, Heneveld, Cooper, DeWitt & Litton

[57] ABSTRACT

A telescopic straw assembly has an outer straw with a collar of reduced diameter at one end through an inner straw of smaller diameter can be withdrawn to increase the length of the straw with a minimum resistance. The inner end of the inner straw has an intermediate portion adjacent its inner end of a larger diameter which is designed to be pulled telescopically into the outer straw's collar portion and in so doing expand the collar portion to provide an airtight seal and firmly hold the straws together. The straws have additional interengaging features to further stabilize them both axially and radially when in extended position.

17 Claims, 4 Drawing Sheets

EXTENSIBLE STRAW ASSEMBLY FOR BEVERAGES

This application is a continuation-in-part of my pending application entitled EXTENSIBLE AND CONTRACTIBLE DOUBLE STRAW, Ser. No. 833,069, filed Feb. 26, 1986 now U.S. Pat. No. 4,688,721.

FIELD OF THE INVENTION

The present invention relates to an improvement in slidably extensible straw assemblies comprising an inner straw component and an outer straw component into which said inner straw component is telescopically inserted, particularly intended for use in beverage consumption.

BACKGROUND OF THE INVENTION

This invention is particularly intended to provide a beverage straw which will be attached to the exterior of the beverage container as the container is delivered to the consumer. A straw assembly attached to a beverage container should preferably have a length greater than a depth of the beverage container to give the user access to the entire contents of the container and prevent an inconvenience which would be experienced should the assembly fall into the container when in use. However, a straw assembly of a length to be conveniently used for this purpose will be substantially longer than the largest dimension of the associated beverage container and, therefore, it would be impossible to attach such straw assembly to the container and expect it to reach the user in useable condition. To overcome this problem, it is desired to provide a straw assembly which can be contracted when attached to the container and extended for actual use. Such an extensible straw assembly comprising an inner straw component telescopically inserted into an outer straw component is well known, but such straw assemblies of prior art construction have encountered various problems, as will be mentioned below because of their construction in which the telescoping ends of the inner and outer straw components are of two different interfitting diameters.

When such a straw assembly is extended and inserted into the container of beverage in actual use, the assembly can be properly handled so long as the inner straw component is pulled in a proper direction, i.e., with its forward end ahead, but the inner straw component will disengage from the outer straw component if the inner straw component is carelessly pulled out in the opposite direction. Further, such prior art straw assemblies have no means for reliably maintaining the assembly in the extended state, namely, no means by which the straw assembly is prevented from readily contracting again and there is a danger that the straw assembly might contract and fall into the container, if the user carelessly pushes the assembly against the bottom of the container.

In view of the problems as set forth above, an extensible straw assembly has already been developed and is well-known, having means to prevent the inner straw component from readily disengaging from the outer straw component and to prevent the assembly, once telescopically extended, from readily contracting again. To do this, the inner straw component has a diametrically flared or enlarged inner end or root portion while the outer straw, adjacent its forward end, has a diametrically reduced portion. Thus, the root of the inner straw engages the reduced forward end of the outer straw when the inner and outer straws are telescopically extended. Also, the outer straw component is further provided adjacent its forward end, e.g., at a boundary position between the blank portion and the diameter-reduced portion of the outer straw component with an inwardly projecting shoulder or stopper adapted to resist retraction of the inner straw into the outer straw.

This extensible straw assembly is very convenient in that the inner straw component is effectively prevented from accidentally disengaging from the outer straw component and the straw assembly, once fully extended, positively maintained in its extended condition without danger that the inner straw might be retracted into the outer straw due to careless handling. Additionally, this improved design provides the outer straw with a tapered portion the inner surface of which is adapted to be brought into surface-contact with the outer surface of the inner straw enlarged inner or root end to provide a seal preventing air leakage between the fully extended straws. However, it has been found to be very difficult to provide cylindrical or conical surfaces of the precise dimensions required to assure an exact surface-contact. Thus, to make straws of such design air seal effective, dimensional errors must be avoided as strictly as possible during production. Thus, quality control is very difficult and demanding, particularly in mass-production and such design involves a serious problem in implementing practice application. In addition, if it is attempted to improve dimensional precision in order to assure the desired airtightness, stickiness or resistance to telescopic movement would correspondingly in crease between the contacting surfaces of the inner surface of the outer straw's tapered portion and the outer surface of the inner straw's flared or root portion. Such stickiness can increase the resistance to telescopic adjustment to such an extent that some users such as children or women are unable to extend the straw assembly for use. Furthermore, if the diameter-reduced portion formed at the forward end of the outer straw is reshaped to present a relatively gentle angle of inclination, the inner straw would not be effectively locked by said diameter-reduced portion and may disengage the outer straw when the user tries to extend the straw assembly with the force necessary to overcome the high resistance due to stickiness.

BRIEF DESCRIPTION OF THE INVENTION

A principal object of the present invention, in view of the above-mentioned problems, is to provide a novel straw assembly for use with a beverage container, involving an essential improvement such that the inner straw component is effectively held against readily disengaging from the outer straw component and the assembly is reliably maintained in its extended condition once the assembly has been fully extended, this extension being capable to being easily achieved even by children or women. At the same time, the inner and outer straw components are tightly locked together in the final stage of extension, and form an effective air seal, regardless of the dimensional variations characteristic of mass-production utilizing economically practical tolerances.

DESCRIPTION OF THE PREFERRED EMBODIMENT

Figure 1:
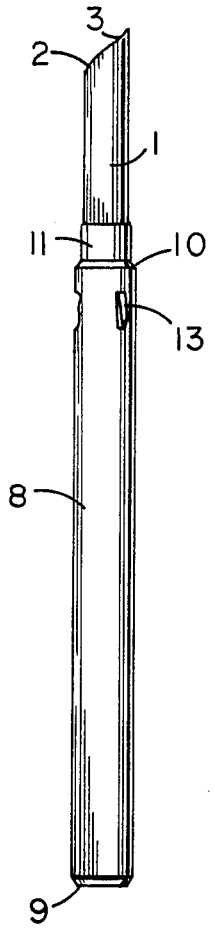
FIG. 1 is a side elevation view of a telescopic straw incorporating this invention.

To achieve the objectives as set forth above, the present invention provides a telescopically extensible straw assembly designed to be used for consumption of a beverage directly from its container. The assembly has an inner straw component telescopically inserted into an outer straw component. The main portion of the inner straw component is of smaller diameter than the inner diameter of the outer straw. Adjacent its inner end or root, the inner straw has an intermediate portion or first collar of enlarged diameter and at its end or root portion a further enlarged portion or second collar. The inside diameter of the main portion of the outer straw is larger than the outside diameter of the main portion of the inner straw, but adjacent its forward end has a section or throat of reduced diameter connected to the main portion by a tapered transition portion or zone. The first collar of the inner straw has an outer diameter slightly larger than the inner diameter of the throat of the outer straw so that the intermediate portion or first collar of the inner straw tightly engages with the throat portion of the outer straw when the inner and outer straws are telescopically fully extended.

Referring to the drawing, reference numeral 1 designates an inner straw having a main portion 1*a* of uniform diameter and having its forward end cut on a slant to form an oblique end 2. An angle at which the forward end is cut to form said oblique end 2 is chosen to provide a sharp tip 3 with which a beverage container can be easily pierced by application of a light force. This main portion 1*a* of the inner straw has adjacent its inner end or root an intermediate section or portion 5 of enlarged diameter integrally connected by a transition or stepped portion 4 to the main portion 1*a* and a further end collar or diameter-enlarged portion 7 formed at said root itself, which is connected by a gently sloped transition portion 6 integrally with the intermediate portion 5.

Reference numeral 8*a* designates the main portion of an outer straw 8 having at its inner end or root a portion 9 of reduced diameter serving to hold the inner straw component against slipping out of the inner end of the outer straw 1. The main portion 8*a* of the outer straw component has, adjacent its forward end, a plurality of circumferentially arranged, inclined latch fingers 13 each terminating at its inner end in an outwardly facing step 14. The rear end of each finger is integral with the main portion 8*a* of the straw through an inwardly offset inclined section 15. Three or four of these latch fingers 13 are arranged in equally spaced intervals circumferentially of the outer straw 8. In forming the latch fingers, the step and the offset portion, it is important that no opening is forming in the wall of the straw to maintain the wall's integrity so that liquid can be drawn through the straw by a small vacuum.

Outwardly of the step 14, the diameter of the outer straw for a short distance is the same as that of the main portion 8*a* forming a short chamber 20. At the outer end of the chamber 20, the straw is provided with a transition section 10 having a relatively steep slope to effect diameter-reduction and a tapered collar portion 11 contiguous with and extending outwardly from said transition section 10. Preferably, the collar portion 11 is tapered.

Figure 2:
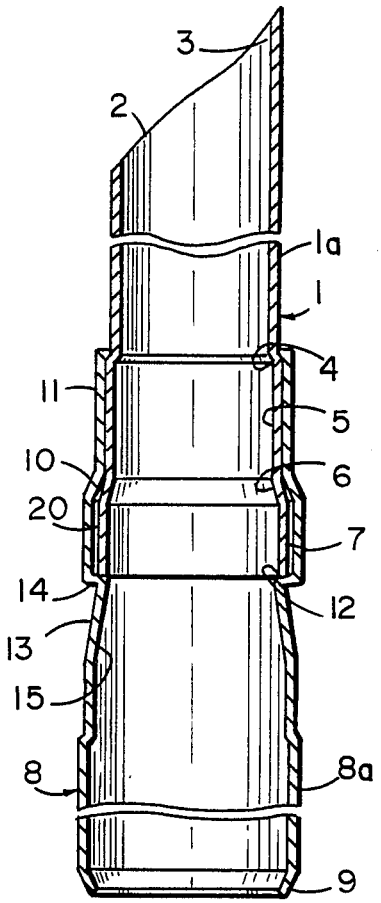
FIG. 2 is an enlarged, broken central section of the straw illustrated in FIG. 1 telescoped to extended condition.

The main portion 1*a* of the inner straw component is telescopically inserted in the main portion 8*a* of the outer straw. Since the main portion 1*a* of the inner straw has an outer diameter slightly smaller than most or all of the inner diameter of tapered collar portion 11, it will slide through the tapered portion without resistance, thus, facilitating withdrawal of the inner straw from the outer straw during extension of the straw assembly. The inner collar 7 or root end of the inner straw connects to the intermediate section through a tapered transition ring section 6 which, when it engages the complementary transition section 10 of the outer straw, provides a stop to avoid the danger that the inner straw might be pulled entirely out of the outer straw. As they are pulled into overlapping position, the intermediate portion 5 and the tapered portion 11 are brought into tight engagement with each other. Although the intermediate portion 5 of the inner straw has a longitudinal dimension substantially equal to that of the tapered portion 11, as illustrated in the specific embodiment shown in FIG. 2, the intermediate portion 5 may have a length greater than that of the tapered portion 11 instead of being equal. In this way, the forward end of the intermediate portion 5 will project from the tapered portion 11 after the straw assembly has been fully extended and, accordingly, it is possible to visually confirm that the extension has been completed.

As has already been noted, the main portion 8*a* of the outer straw is provided with an inwardly directed finger or positioning projection 13 serving also as a step or stop 14. During extension of the inner straw the inner collar or portion 7 formed at the root of the inner straw passes through the positioning projection 13 just before the intermediate portion 5 and tapered portion 11 fully overlap each other. These inwardly directed projections 13 have an inner diameter substantially corresponding to the outer diameter of the main portion 1*a* of the inner straw. The forward end of the projection 13 is substantially perpendicular to the surface of the outer straw while the finger portion 15 thereof is gently sloped with respect to the surface of the outer straw. Although the projection 13 is elongated longitudinally of the straw in the embodiment as shown, the projection 13 is not limited to such longitudinally elongate shape and may be of a spot-like or laterally elongate shape.

Figure 4:
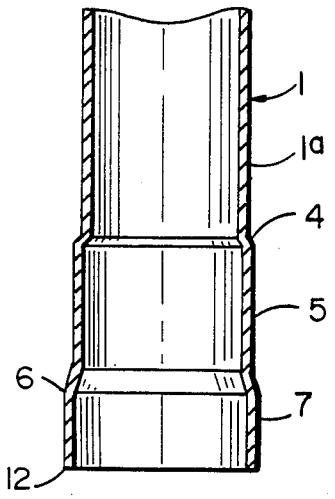
FIG. 4 is a fragmentary, enlarged central sectional view of an inner end of the inner straw component of the straw assembly illustrated in FIGS. 1 and 2.
Figure 3:
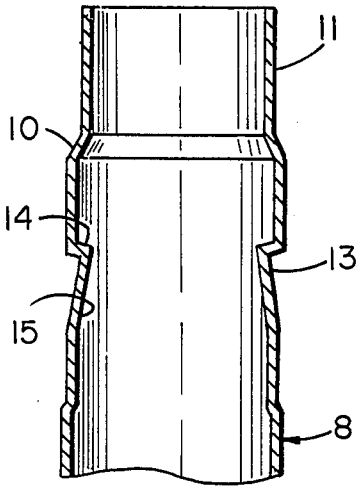
FIG. 3 is a fragmentary, enlarged central section view of the outer end of the outer straw component of the straw assembly illustrated in FIGS. 1 and 2.
Figure 5:
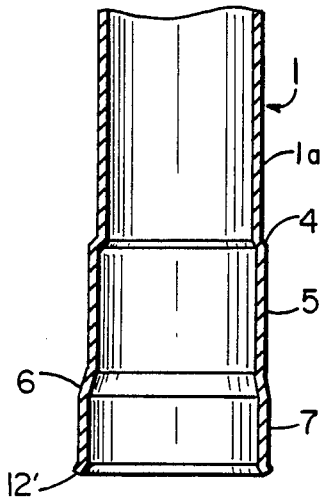
FIG. 5 is a fragmentary, enlarged central section view of the inner end of a modified construction for the inner straw component.

FIG. 5 illustrates another embodiment of the inner straw. This embodiment is essentially similar to the embodiment of FIG. 4 except that the enlarged portion 7 formed at the root has an edge 12' which flares or projects slightly outwardly. The slight outward projection of the edge 12' is not only effective for reinforcing and stiffening the root of the inner straw but also provides lateral stability by limiting rocking motion of the inner straw with respect to the outer straw.

Figure 6:
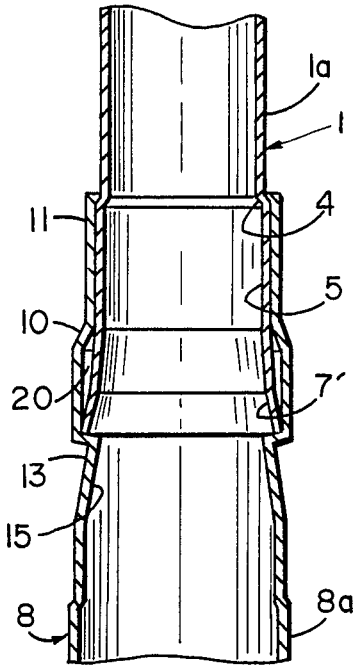
FIG. 6 is a view similar to FIG. 2 illustrating a further modified construction for the straw assembly.

The further embodiment of FIG. 6 is characterized by the diameter-enlarged portion 7' formed at the root. The diameter-enlarged portion 7' of FIG. 6 is formed by flaring the root toward the end while the portion 7 of FIGS. 2 through 5 is cylindrical.

Figure 7:
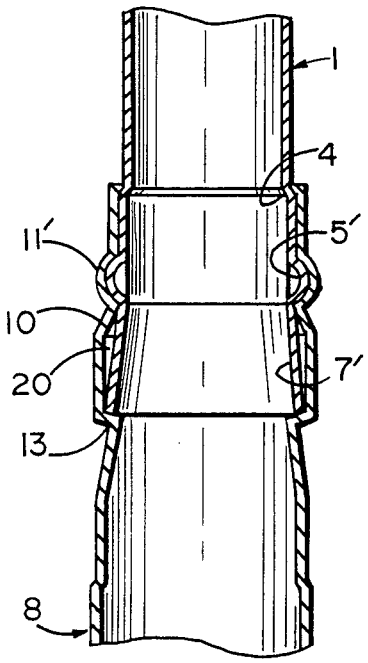
FIG. 7 is a view similar to FIG. 2 illustrating another modified construction for the straw assembly.

FIG. 7 illustrates still another embodiment of the present invention characterized in that the intermediate portion 5' of the inner straw component as well as the tapered collar portion 11' formed adjacent the forward end of the outer straw have complementary cross-sections which are curved smoothly outwardly to form interfitting projections to latch the straws together. This feature contributes to the reliability of the pressurized engagement of these portions.

Figure 8:
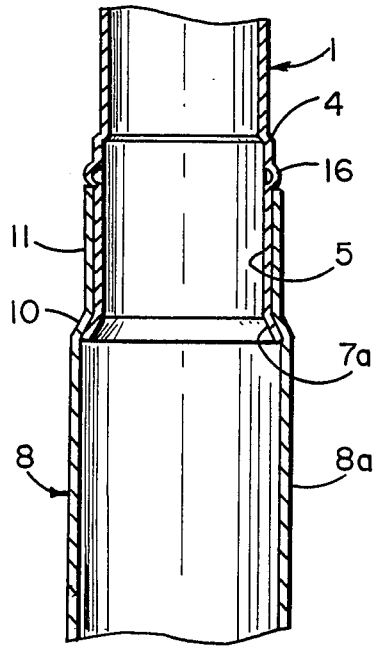
FIG. 8 is a view similar to FIG. 2 illustrating a still further modified construction for the straw assembly.

Finally, FIG. 8 illustrates still another embodiment of the present invention in which the positioning projection serving also as the stop is implemented as an outwardly directed projection 16 formed in the outer periphery of the inner straw component. With this embodiment, the user may conveniently stop withdrawing the inner straw component upon appearance of the projection 16. Therefore, this construction is advantageous in that the optimal position at which the extension of the inner straw component 1 should be stopped is visually confirmed. Preferably, the spacing between projection 16 and the flared portion 7*a* is such that the flared portion 7*a* engages the transition section 10 just as the projection 16 seats on the outer end of the outer straw 8 (FIG. 8).

With the extensible straw assembly according to the present invention which may be embodied in various ways, as has been described hereinabove, the inner straw component 1 is telescopically surrounded by the outer straw component 8 with the forward end of the inner straw component 1 slightly projecting out of the outer straw component 8 as seen in FIG. 1 prior to its use, as in the case of the well-known extensible straw assemblies now in use. In use, the inner straw 1 is withdrawn from the outer straw with the outer or forward end of said inner straw held between the user's fingers. The operation of such withdrawal can be easily and smoothly done because the inner straw 1 is of a smaller diameter and its outer diameter is slightly smaller than the inner diameter of all or almost all of the tapered collar portion 11 formed adjacent the forward end of the outer straw. At the final stage of the withdrawal, i.e., when the intermediate portion 5 of the inner straw 1 reaches the tapered collar portion 11 of the outer straw 8, further withdrawal is resisted. Now the inner straw 1 must be further pulled with a force sufficient to overcome this resistance until the intermediate portion 5 and said tapered portion 11 fully overlap each other. At this point, the end 12 of the diameter-enlarged or flared portion 7 formed at the root of the inner straw 1 has passed through the positioning projections 13 formed in the outer straw 8. Feeling the click resulting from this indicates completion of the withdrawal and, thereupon, the user may stop the operation of withdrawal. In this state, the intermediate portion 5 of the inner straw 1 presses against the inner wall of the tapered portion 11 of the outer straw forming a tight engagement therewith and developing an extremely high resistance adapted to reliably prevent the inner straw component 1 from being undesirably retracted. The tightly engaged relationship of these both portions also contributes to assurance of an effective airtight seal. Because the collar and intermediate sections overlap and are clamped to each other for a substantial length, the sealing effect is particularly good and the straws are firmly held together, providing a straw having the basic rigidity of a single, non-telescoping straw.

In accordance with the present invention, as will be obvious from the aforegoing description, the inner straw component has an outer diameter smaller than an inner diameter of all or almost all of the tapered portion formed adjacent the forward end of the outer straw component to facilitate telescopic movement of the inner and outer straw components to enable the straw assembly to be easily easily extended with a minimum of effort. Additionally, at the final stage of extension, the intermediate portion of the inner straw presses against the inner wall of the tapered portion formed in the outer straw to provide a tight engagement between the straws accordingly, coupling the inner and outer straws to each other firmly enough to overcome the reaction encountered by the extended straw assembly during piercing of the beverage container. Furthermore, the tightly engaged relationship established between these both portions also contributes to assure a desired airtight seal between the straws.

I claim:

1. An extensible straw for beverages having inner and outer telescopically interfitted straws, the outer one of said straws having an elongated main portion, the outer end of which is formed into a collar portion providing a throat of reduced internal cross section; an inner straw telescopically received within said outer straw and when fully retracted into said outer straw the outer end thereof projects beyond said collar portion, said inner straw having a main portion of an outer diameter such that it will easily slide through said collar portion without requiring radial expansion thereof, the inner end of said inner straw having an intermediate section adjacent the inner end thereof of an outer diameter greater than the inner diameter of said collar portion, outwardly tapered complementary transition sections on both said inner and outer straws positioned to engage to limit outward extension of said inner straw and radially inwardly extending stop means formed in the walls of said outer straw for engaging the inner end of said inner straw when said transition sections are engaged for preventing retraction of said inner straw into said outer straw.

2. An extensible straw as described in claim 1 wherein both said collar portion and said intermediate section are axially elongated.

3. An extensible straw as described in claim 2 wherein said stop means is a radially inwardly extending portion of the wall of said outer straw defining a passage of a diameter no greater than the inside diameter of the inner end of said inner straw.

4. An extensible straw as described in claim 3 wherein said inner straw has an end section between said intermediate section and the inner end of said inner straw, said end section being diametrically larger than said intermediate section.

5. An extensible straw as described in claim 4 wherein said transition section on said inner straw is between said intermediate and end sections.

6. An extensible straw as described in claim 3 wherein said inner straw has an end section between said intermediate section and the inner end of said inner straw, the inner end of said end section being radially outwardly flared to engage on said stop means.

7. An extensible straw as described in claim 6 wherein the inner end of said inner straw has an outer diameter substantially equal to the inner diameter of the main portion of said outer straw.

8. An extensible straw as described in claim 2 wherein said stop means is a plurality of circumferentially equally spaced radially inwardly extending projections formed in the wall of the outer straw, said projections being so formed that the integrity of the air flow seal of the wall is maintained.

9. An extensible straw as described in claim 2 wherein the engagement between said collar portion and intermediate section forms an airtight seal.

10. An extensible straw for beverages having inner and outer telescopically interfitted straws, the outer one of said straws having an elongated main portion, the outer end of which is formed into a collar portion providing a throat of reduced internal cross section; said inner straw telescopically received within said outer straw and when fully retracted into said outer straw the outer end thereof projecting beyond said collar portion, said inner straw having a main portion of an outer diameter such that it will easily slide through said collar portion without requiring radial expansion thereof, said inner straw having an intermediate section adjacent the inner end thereof of an outer diameter greater than the inner diameter of said collar portion whereby said intermediate section causes radial extension of said collar portion for forming an airtight seal between said straws when the inner straw is fully extended, stop means for preventing further extension of the straws when the collar portion and intermediate section are fully telescopically engaged.

11. An extensible straw as described in claim 10 wherein said collar is tapered.

12. An extensible straw as described in claim 10 wherein said collar is axially elongated and of progressively smaller diameter in an outward direction.

13. An extensible straw as described in claim 10 wherein interengaging means are provided on both of said straws for preventing retraction of said inner straw into said outer straw when the former is fully extended.

14. An extensible straw as described in claim 13 wherein said interengaging means are outward, convex interfitting protrusions on both said collar portion and said intermediation section.

15. An extensible straw as described in claim 10 wherein said interengaging means are each shaped as segments of a sphere and are arranged at equally spaced circumferential intervals.

16. An extensible as described in claim 14 wherein said interengaging means is an outwardly convex protrusion adjacent the outer end of said intermediate section spaced from said skirt such that when said skirt and transition section are engaged said protrusion seats against the outer end of said outer straw.

17. An extensible straw as described in claim 16 wherein said protrusion is formed by a plurality of rounded radially outwardly extending protrusions formed in the wall of the intermediate section for preventing retraction of the inner straw, once it has been fully extended.

* * * * *

UNITED STATES PATENT AND TRADEMARK OFFICE

CERTIFICATE OF CORRECTION

PATENT NO. : 4,736,887

DATED : April 12, 1988

INVENTOR(S) : Koichi Inaba

It is certified that error appears in the above-identified patent and that said Letters Patent is hereby corrected as shown below:

Column 2, Line 33:
"in crease" should be -- increase --.

Column 6, Line 13:
after "easily" delete -- easily --.

Column 8, Claim 14, Line 15:
"intermediation" should be -- intermediate --.

Column 8, Claim 16, Line 20:
after "extensible" insert -- straw --.

Signed and Sealed this

Sixth Day of December, 1988

*Attest:*

DONALD J. QUIGG

*Attesting Officer*

*Commissioner of Patents and Trademarks*